US010137050B2

(12) United States Patent
Goffer

(10) Patent No.: US 10,137,050 B2
(45) Date of Patent: Nov. 27, 2018

(54) GAIT DEVICE WITH A CRUTCH

(71) Applicant: ReWalk Robotics Ltd., Yokneam (IL)

(72) Inventor: Amit Goffer, Kiryat Tivon (IL)

(73) Assignee: ReWalk Robotics Ltd., Yokneam (IL)

( * ) Notice: Subject to any disclaimer, the term of this patent is extended or adjusted under 35 U.S.C. 154(b) by 259 days.

(21) Appl. No.: 13/744,396

(22) Filed: Jan. 17, 2013

(65) Prior Publication Data

US 2014/0196757 A1 Jul. 17, 2014

(51) Int. Cl.

| | |
|---|---|
| ***A61H 3/02*** | (2006.01) |
| ***A61H 3/04*** | (2006.01) |
| ***A61H 1/02*** | (2006.01) |
| ***A61H 3/00*** | (2006.01) |

(52) U.S. Cl.

CPC ..... *A61H 3/02* (2013.01); *A61H 1/0262* (2013.01); *A61H 3/00* (2013.01); *A61H 3/04* (2013.01); *A61H 3/008* (2013.01); *A61H 2003/007* (2013.01); *A61H 2003/046* (2013.01); *A61H 2201/018* (2013.01); *A61H 2201/0176* (2013.01); *A61H 2201/0192* (2013.01); *A61H 2201/5007* (2013.01); *A61H 2201/5015* (2013.01); *A61H 2201/5025* (2013.01); *A61H 2201/5061* (2013.01); *A61H 2201/5066* (2013.01); *A61H 2201/5069* (2013.01); *A61H 2201/5097* (2013.01)

(58) Field of Classification Search

USPC ..... 601/5, 33–35; 602/23, 28; 623/30, 40; 482/66, 75

See application file for complete search history.

(56) References Cited

U.S. PATENT DOCUMENTS

| | | | | |
|---|---|---|---|---|
| 2,077,569 A * | 4/1937 | Kish | A61H 3/04 135/67 |
| 2,445,942 A | 7/1948 | Dusinberre et al. | |
| 4,697,808 A * | 10/1987 | Larson et al. | 482/51 |
| 4,946,156 A * | 8/1990 | Hart | 482/66 |
| 5,636,651 A * | 6/1997 | Einbinder | 135/67 |
| 6,378,883 B1 * | 4/2002 | Epstein | A61G 5/04 180/6.5 |
| 7,153,242 B2 * | 12/2006 | Goffer | 482/66 |
| 7,992,584 B1 * | 8/2011 | Birnbaum | A61H 3/04 135/67 |

(Continued)

FOREIGN PATENT DOCUMENTS

| | | |
|---|---|---|
| CN | 102440891 | 5/2012 |
| CN | 102499859 A | 6/2012 |

(Continued)

OTHER PUBLICATIONS

International Search Report for Application No. PCT/IL2014/050030, dated Apr. 27, 2014.

(Continued)

*Primary Examiner* — Ophelia A Hawthorne
(74) *Attorney, Agent, or Firm* — Cooley LLP

(57) ABSTRACT

A system method and device, the system including a gait device for facilitating a gait of a person over a surface and one or a plurality of crutches to provide support over the surface the gait device, each of said one or a plurality of crutches including a locomotion facilitator to enhance locomotion of that crutch over the surface and a mechanism to modify the locomotion of that crutch over the surface.

20 Claims, 16 Drawing Sheets

(56) References Cited

U.S. PATENT DOCUMENTS

| | | | | |
|---|---|---|---|---|
| 7,998,096 | B1 * | 8/2011 | Skoog | A61H 3/00 601/35 |
| 8,267,876 | B2 * | 9/2012 | Ashihara et al. | 601/34 |
| 8,707,975 | B2 * | 4/2014 | Larson | A61H 3/0277 135/77 |
| 2011/0023920 | A1 * | 2/2011 | Bolton | A61H 3/04 135/66 |
| 2012/0029696 | A1 | 2/2012 | Ota et al. | |

FOREIGN PATENT DOCUMENTS

| | | | |
|---|---|---|---|
| JP | H09154903 | A | 6/1997 |
| JP | 3042693 | U | 10/1997 |
| JP | 2005-137410 | A | 6/2005 |
| JP | 2009-268655 | A | 11/2009 |
| JP | 2009273565 | A | 11/2009 |
| JP | 2011-062463 | A | 3/2011 |
| WO | WO 2012/027336 | A1 | 3/2012 |
| WO | WO 2012/037555 | A1 | 3/2012 |

OTHER PUBLICATIONS

Supplementary European Search Report dated Jun. 24, 2016 for EP Application No. 14740263.0, filed Jan. 13, 2014.

* cited by examiner

GAIT DEVICE WITH A CRUTCH

FIELD OF THE INVENTION

The present invention relates generally to a gait device with a crutch.

BACKGROUND OF THE INVENTION

About 2 million people in the USA alone are confined to wheelchairs that serve as their only means of mobility. As a result, their lives are full of endless obstacles such as stairs, rugged pavement and narrow passages. Furthermore, many disabled people lack the ability to remain in a standing position for long periods of time, and often have only limited upper-body movements. In order to prevent rapid health deterioration, expensive equipment such as standing frames and trainers must often be used in addition to ample physio/hydro-therapy.

Typically rehabilitation devices for quadriplegics confined to wheelchairs as well as available devices in rehabilitation institutions are used for training purposes only. Exoskeleton (ES) and RGO (Reciprocating Gait Orthosis)-based devices, require crutches or walking frames (walkers) in order to enable/restore up-right mobility to people with mobility impairment such as paraplegics. But a significant number of people with mobility impairment are not able to hold or support themselves by commercial crutches or walkers (e.g., quadriplegics).

A solution that enables daily independent activities that restore the dignity of disabled quadriplegics, dramatically ease their lives, extend their life expectancies and reduce medical and other related expenses is so far not available.

It is therefore an object of the present invention to provide one or a plurality of crutches, that enables disabled individuals, such as, but not limited to, quadriplegics, that are typically confined to wheelchairs, and cannot use regular crutches in walk-assistive devices, such as, but not limited to, exoskeletons or orthoses, due to, for example, the weakness of the disabled individual's hands and/or shoulders.

SUMMARY OF THE INVENTION

It is therefore an object of the present invention to provide a system including a gait device for facilitating a gait of a person over a surface, and one or a plurality of crutches to provide support over the surface to the person using the gait device, each of said one or a plurality of crutches including a locomotion facilitator to enhance locomotion of that crutch over the surface and a mechanism to modify the locomotion of that crutch over the surface.

Furthermore, in accordance with some embodiments of the present invention, the locomotion facilitator includes a wheel.

Furthermore, in accordance with some embodiments of the present invention, the locomotion facilitator is retractable.

Furthermore, in accordance with some embodiments of the present invention, the locomotion facilitator includes a motor.

Furthermore, in accordance with some embodiments of the present invention, the mechanism to modify the locomotion of each of said one or a plurality of crutches over the surface is selected from the group of mechanisms consisting of a mechanical mechanism having a pin and a ratchet, a mechanical brake mechanism and an electrical brake mechanism.

Furthermore, in accordance with some embodiments of the present invention, a crutch of said one or a plurality of crutches further includes a manipulatable handle.

Furthermore, in accordance with some embodiments of the present invention, the manipulatable handle is configured to facilitate the modification of the locomotion of said one or a plurality of crutches over the surface.

Furthermore, in accordance with some embodiments of the present invention, the mechanism to modify the locomotion of that crutch over the surface includes a limiter to limit an angular range of that crutch.

Furthermore, in accordance with some embodiments of the present invention, wherein the gait device includes a motorized exoskeleton device.

Furthermore, in accordance with some embodiments of the present invention, said one or a plurality of crutches includes telescoping components.

Furthermore, in accordance with some embodiments of the present invention, a length of a crutch of said one or a plurality of crutches is modifiable in response to a change in an environment.

Furthermore, in accordance with some embodiments of the present invention, a processing unit to control the mechanism to modify the locomotion of that crutch over the surface.

Furthermore, in accordance with some embodiments of the present invention, said one or a plurality of crutches includes at least two crutches, and wherein said at least two crutches are coupled.

There is further provided, in accordance with some embodiments of the present invention, one or a plurality of crutches for use with a gait device to provide support over the surface to the person using the gait device, each of said one or a plurality of crutches including a locomotion facilitator to enhance locomotion of that crutch over the surface and a mechanism to modify the locomotion of that crutch over the surface.

Furthermore, in accordance with some embodiments of the present invention, the mechanism to modify the locomotion of each of said one or a plurality of crutches over the surface is selected from the group of mechanisms consisting of a mechanical mechanism having a pin and a ratchet, a mechanical brake mechanism and an electrical brake mechanism.

Furthermore, in accordance with some embodiments of the present invention, a length of a crutch of said one or a plurality of crutches is modifiable in response to a change in an environment.

Furthermore, in accordance with some embodiments of the present invention, the mechanism to modify the locomotion of the crutch over the surface includes a limiter to limit an angular range of the crutch.

There is further provided, in accordance with some embodiments of the present invention, a method for including facilitating a gait of a person over a surface using a gait device for and using one or a plurality of crutches to provide support over the surface to the person using the gait device, each of said one or a plurality of crutches includes a locomotion facilitator to enhance locomotion of that crutch over the surface and a mechanism to modify the locomotion of that crutch over the surface.

Furthermore, in accordance with some embodiments of the present invention, the method for changing a direction of locomotion of the person using the gait device.

Furthermore, in accordance with some embodiments of the present invention, the method for modifying a length of a crutch of said one or a plurality of crutches in response to a change in an environment.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

Figure 1A:
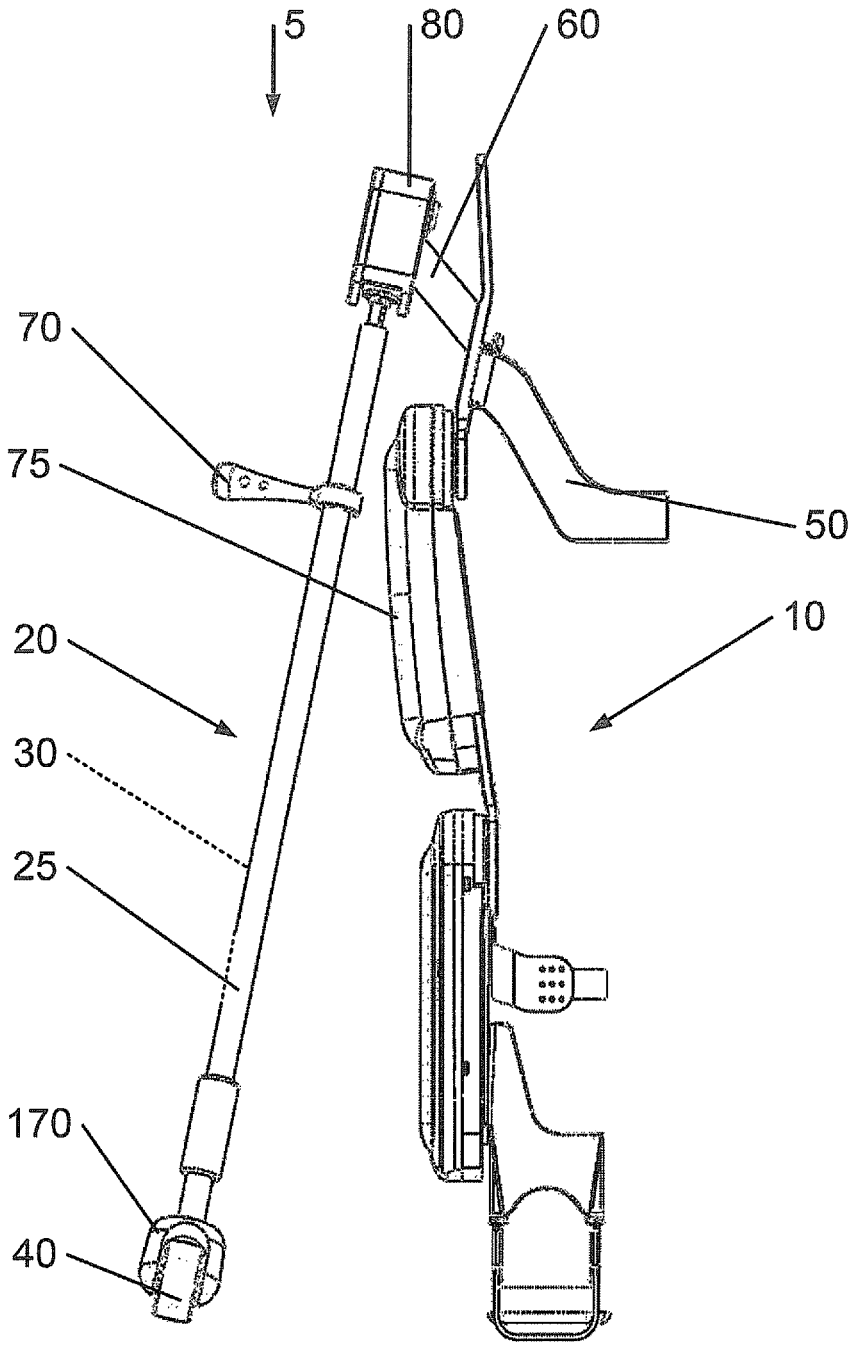
FIG. 1A is a schematic illustration of the crutches that may be used with a motorized exoskeleton device within a motorized exoskeleton system, according to an embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the methods and apparatus. However, it will be understood by those skilled in the art that the present methods and apparatus may be practiced without these specific details. In other instances, well-known methods, procedures, and components have not been described in detail so as not to obscure the present methods and apparatus.

Although the examples disclosed and discussed herein are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method examples described herein are not constrained to a particular order or sequence. Additionally, some of the described method examples or elements thereof can occur or be performed at the same point in time.

Unless specifically stated otherwise, as apparent from the following discussions, it is appreciated that throughout the specification, discussions utilizing terms such as "adding", "associating" "selecting," "evaluating," "processing," "computing," "calculating," "determining," "designating," "allocating" or the like, refer to the actions and/or processes of a computer, computer processor or computing system, or similar electronic computing device, that manipulate, execute and/or transform data represented as physical, such as electronic, quantities within the computing system's registers and/or memories into other data similarly represented as physical quantities within the computing system's memories, registers or other such information storage, transmission or display devices.

Mobility aids, such as a crutch, a modified crutch, an underarm crutch, strutters, auxiliary crutches, loftstrand crutches a brace, a prop, a cane, and/or crutch like devices (hereinafter crutch) may be used with a motorized exoskeleton device.

Crutches may be made of one or a plurality of materials including, wood, metal alloys, carbon fiber or glass fiber reinforced composites, plastics, other polymers, and/or other materials.

The crutches may be configured to be used with a motorized exoskeleton system. A motorized exoskeleton system may include the motorized exoskeleton device, a plurality of crutches and/or other components. The motorized exoskeleton system may include a motorized brace system for the lower body and lower limbs that may be typically attached to the body of a user, in some embodiments, under the clothes. In some embodiments of the invention, the motorized exoskeleton device may be attached to the body of the user on top of the clothing.

Typically, the motorized exoskeleton system may be useful in facilitating the up-right locomotion of a user.

The use of the motorized exoskeleton system may enable a users to restore some or most of their daily activities, especially stance and abilities, the abilities lost or diminished typically as the result of a disability. The motorized exoskeleton system may enable a non-disabled user to exert forces greater than their muscles can currently provide.

In addition to stance and locomotion, the motorized exoskeleton system may support other mobility functions such as upright position to sitting position transitions and stairs climbing and descending.

The motorized exoskeleton system may suit users who may otherwise not be suited by a motorized exoskeleton device, including those with a wide range of disabilities. These disabilities may include paraplegia, quadriplegia, hemiplegia, polio-resultant paralysis and other difficult to severe mobility issues.

In some embodiments of the invention, the motorized exoskeleton system allows vertical stance and locomotion by means of an independent device that generally comprises a detachable light supporting structure as well as propulsion and control means.

The use of the motorized exoskeleton system may make it possible to relieve the incompetence of postural tonus as well as reconstituting the physiological mechanism of the podal support and walking. Consequently, the motorized exoskeleton system, may, in some embodiments, reduce the need for wheelchairs among the disabled community. The motorized exoskeleton system may provide a better independence to the user and the ability to overcome obstacles such as stairs and/or other obstacles.

The crutch may be used with other supportive devices and systems, including, for example, gait devices such as exoskeletons, motorized exoskeletons, and reciprocating gait orthsosis based devices. Reciprocating Gait Orthoses (RGO's) may be employed by people who require them for support when standing or walking. Crutches may be used with other types of orthoses including upper limb orthoses, lower limb orthoses and other types of orthoses.

The crutches may be used by users who may not otherwise be able to hold or support themselves with non-modified crutches. The crutches may also be used by users who are able to hold or support themselves with non-modified crutches.

FIG. 1A is a schematic illustration of crutches that may be used with a motorized exoskeleton device within a motorized exoskeleton system.

Motorized exoskeleton device 10, and or other gait devices, a portion of the motorized exoskeleton device depicted herein, may be part of a motorized exoskeleton system 5 as described herein. Motorized exoskeleton system may be configured to facilitate the locomotion of a user over a surface. The surface may include the ground, a floor, an obstacle, steps, ramps and other surfaces over which a user may intend to traverse.

Motorized exoskeleton system typically includes two crutches 20. Crutch 20 may be modified crutches or crutch like devices. Crutch 20 includes a tube 30. In some embodiments of the invention, Tube 30 may be constructed of steel, a steel alloy, carbon fiber and/or other materials. Tube 30 may be hollow, e.g., crutch 20 may have one or a plurality of inner hollows 25. Tube 30 may be coated, e.g., to prevent corrosion or damage. Tube 30 may be a large portion of the crutch length. Tube 30 may be cylindrical or it may have other geometries.

In some embodiments of the invention, tube 30 may be telescopic. Tube 30 may telescope in response to a change in the environment, including, for example, an obstacle or the need for a user to sit down or get up from a sitting position.

Crutch 20 may include one or a plurality of tubes 30. Crutch 20 may include one or a plurality of devices configured to interact with a surface, the surface may be the ground, a floor, or a surface that a user of motorized exoskeleton system 5 is traversing. The surface may be flat or nearly flat. The surface may have an upward incline, a downward incline, one or a plurality of steps, and/or one or a plurality of obstacles.

In some embodiments of the invention, tube 30 may telescope via a powered mechanism. Tubes 30 may telescope automatically, semi-automatically or manually. Tubes 30 may telescope via a powered mechanism, the powered mechanism may be mechanical, electromechanically, magnetic, electromagnetic or other mechanisms. A motor for powering the telescoping of tubes 30 may be inside crutch 20.

Crutch 20 includes one or a plurality of locomotion facilitators. Locomotion facilitators may be one or a plurality of wheels 40. In some embodiments of the invention, crutch 20 may include other devices configured to interact with a surface, including wheel like devices, include skis, tennis balls, or other devices configured to interact with a surface to promote, inhibit or otherwise change mobility.

Wheels 40 may be made of wood, metal alloys, rubber, carbon fiber or glass fiber reinforced composites, plastics, other polymers, and/or other materials. Wheels 40 may be coated. Wheels 40 may be in singletons, pairs or other multiples. Wheels 40 may be contained within or may be coupled to an outer surface of tube 30 or another surface of another component of crutch 20.

Crutch 20 has one or a plurality of sensors 170. Crutch 20 may have other devices configured to receive data and, in some embodiments of the invention, communicate that data to motorized exoskeleton device 10, other devices in motorized exoskeleton system 5 or devices external to motorized exoskeleton system 5. Sensors may be configured to measure speed, pressure, angle, orientation and or other factors.

The one or a plurality of crutches 20 is coupled to motorized exoskeleton device 10 via a coupling unit 60. Pelvic support 50 is coupled to coupling unit. Coupling unit 60 may be configured to couple crutch 20, or may otherwise allow for the coupling of crutch 20. Coupling unit 60 may be a torso support member of motorized exoskeleton device 10.

Crutch 20 may include components configured to couple, or to help couple crutch 20 to motorized exoskeleton device 10 via coupling unit 60.

Coupling of one or a plurality of crutches 20 to motorized exoskeleton device 10 via one or a plurality of coupling units 60, or additional components, may allow the user to carry, hold or otherwise transport and/or use crutch 20.

Crutch 20 has a manipulatable handle 70. In some embodiments of the invention, wheel 40 may be configured to enable the sliding of crutch 20 on a surface. In some embodiments of the invention, the user may slide crutch 20 forward using, for example, devices coupled to crutch 20, including manipulatable handle 70. Manipulatable handle may be manipulatable in at least one axis, e.g., up and down. The manipulation of handle 70 may be configured to change the configuration or to otherwise control crutch 20. The user may manipulate the crutch in a direction, by interacting with handle 70 in the desired direction of locomotion. The user may manipulate the crutch in a direction, by interacting with handle 70 in a direction different that the desired direction of locomotion. In some embodiments of the invention, the user may push the crutch forward by pushing handle 70 forward. In some embodiments of the invention, the user may push crutch 20 forward by simultaneously manipulating handle 70 in at least a single axis. For example, the user may push crutch 20 forward by pulling up and pushing forward handle 70. A user may slide crutch 20 forward via other interactions with crutch 20 including, mechanical, electrical and other methods.

limiter 80 is configured to limit a movement of crutch 20, e.g., the angular range of motion of crutch 20, e.g., when crutch 20 is coupled to motorized exoskeleton device 10. An angular range or angular movement of crutch 20 may be mechanically or otherwise limited. In some embodiments of the invention, the angular range of crutch 20 may be limited to 10-30 degrees in a forward direction, e.g., 20 degrees forward. The angular range of crutch 20 may be limited to 0-20 degrees backward, e.g., 10 degrees in a backward direction. Limiter 80 may serve to modify the locomotion of the crutch over the surface.

Figure 1B:
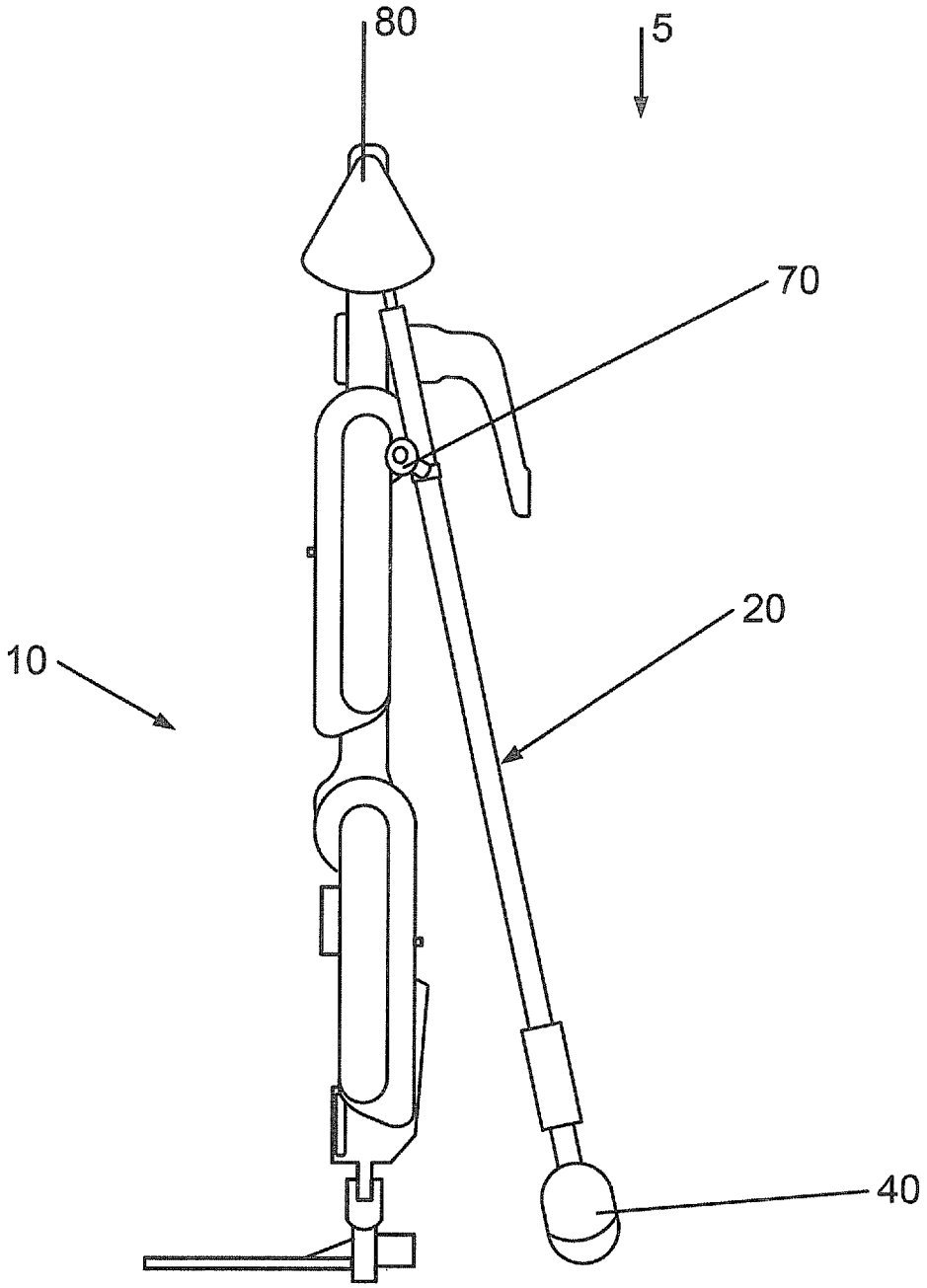
FIG. 1B is a schematic illustration presenting a side view of the crutches that may be used with a motorized exoskeleton device within a motorized exoskeleton system.

FIG. 1B is a schematic illustration presenting a side view of the new type of crutches that may be used with a motorized exoskeleton device within a motorized exoskeleton system.

Motorized exoskeleton device 10, a portion thereof depicted herein, may be part of a motorized exoskeleton system 5. Motorized exoskeleton system typically includes two crutches 20.

Crutch 20 includes a limiter 80 to mechanically or otherwise limit the angular movement of crutch 20. Limiter 80 is presented from a side view, e.g., where the direction of locomotion is toward the left side of FIG. 1B.

Crutch 20 includes one or a plurality of devices configured to interact with a surface. The one or a plurality of devices configured to interact with a surface may include one or a plurality of wheels 40 or wheel like devices.

Crutch 20 includes handle 70. Handle 70 may be configurable to provide different functions to the user of motorized exoskeleton system 5.

Figure 2A:
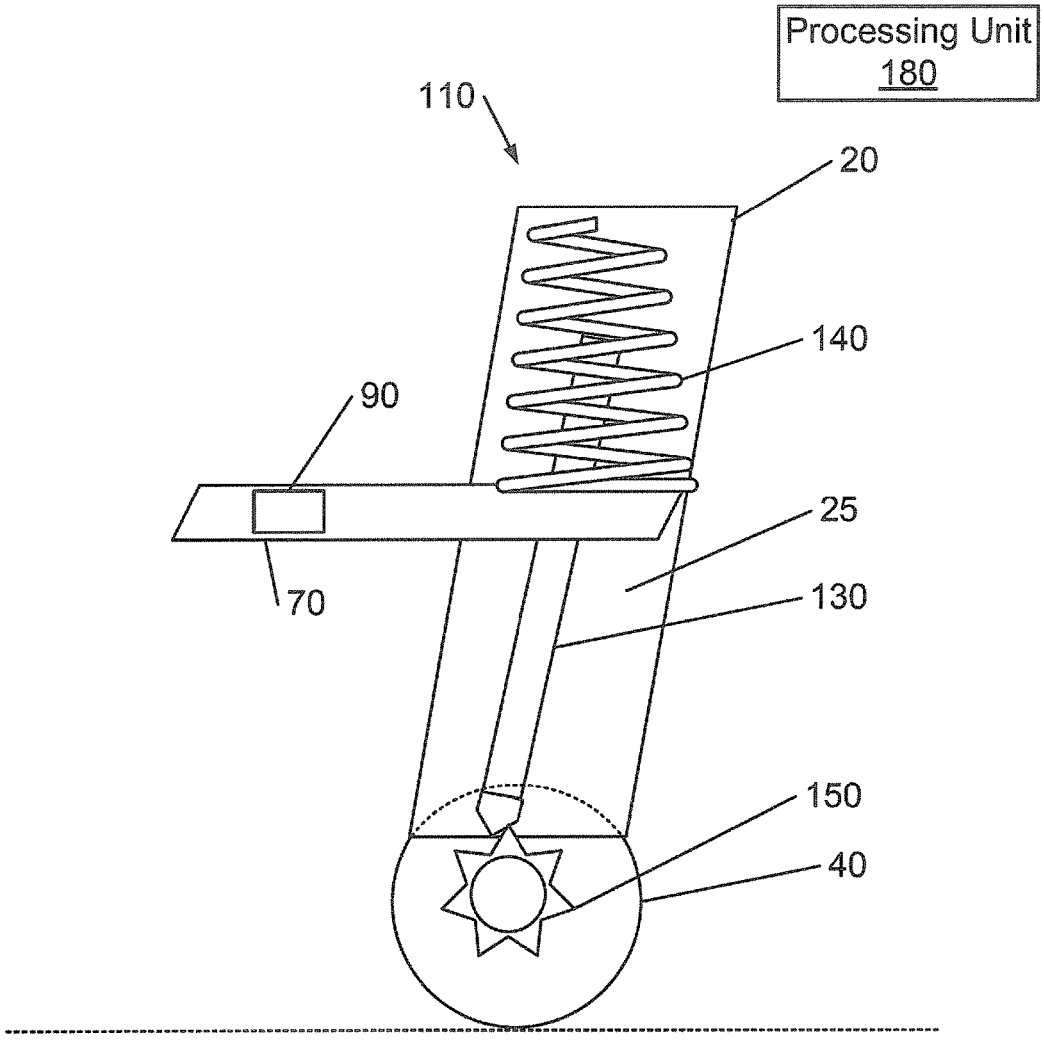
FIG. 2A is a schematic illustration crutches containing a handle and a braking/release mechanism within a motorized exoskeleton system, according to an embodiment of the present invention.

FIG. 2A is a schematic illustration a crutch containing a handle and a braking/release mechanism within a motorized exoskeleton system, according to an embodiment of the present invention.

The motorized exoskeleton device may be an exoskeleton gait device. In some embodiments of the invention, one or a plurality of handles 70 may mechanically, or in some embodiments of the invention, semi-mechanically shifted to an up and/or down position.

In some embodiments of the invention, one or a plurality of handles 70 may mechanically, or in some embodiments of the invention, semi-mechanically shifted to a forward and/or backward position.

Handle 70 include interfaces 90. In some embodiments of the invention, interfaces 90 may be buttons or touch sensitive locations that may control one or a plurality of components within motorized exoskeleton system 5.

Crutch 20 includes a locking mechanism 110. Locking mechanism 110 may serve to modify the locomotion of the crutch over the surface.

Locking mechanism 110, e.g., a wheel lock and/or release mechanism may prevent the crutch from moving beyond a particular location, e.g., moving further in a particular direction by limiting the rotation of wheels 40. In some embodiments of the invention, locking mechanism 110 may prevent the one or a plurality of devices configured to interact with a surface, e.g., wheels 40, from allowing crutch 20 to move.

In some embodiments of the invention, another component within the motorized exoskeleton system may control the locking mechanism 110. Locking mechanism 110 may be mechanical, electrical, via hydraulics and/or other methods.

As depicted in FIG. 2A, one or a plurality of wheels 40 is configured to have its rotation bounded, in some embodiments of the invention, by a ratchet 150 or similar mechanism, e.g., on an axle of wheel 40. The bounding of the rotation of wheel 40 may limit the ability of wheel 40 to rotate in the opposite direction of a desired direction of travel and/or locomotion of the user. The bounding of the rotation of wheel 40 may be overridden by the user. In some embodiments of the invention, the bounding of the rotation of wheel 40 may be overridden by mechanical, electrical, hydraulic or other means.

In some embodiments of the invention a control switch, button, or other interface to override the bounding of the rotation of wheel 40 may be located in a component of motorized exoskeleton system 5. The control switch, button, or other interface to override the bounding of the rotation of wheel 40 may be located in a component outside of motorized exoskeleton system 5. The control switch, button, or other interface to override the bounding of the rotation of wheel 40 may be located in a component of crutch 20. A control switch, button, or other interface to override the bounding of the rotation of wheel 40 may be located in handle 70.

In some embodiments of the invention, inner hollow 25 of crutch 20 may contain locking mechanism 110 for wheel 40.

As depicted in FIG. 2A, locking mechanism 110 includes a mechanical arrangement wherein a pin 130, e.g., a spindle, may slide up or down, the sliding up and down configured to be a component of the braking system.

Pin 130 may be pushed down by a spring 140 and/or other mechanisms, and lifted by shifting handle 70 upward. The lifting may release the locking mechanism engaged by pin 130.

In some embodiments of the invention, the lifting of handle 70 may be done manually, mechanically, and or with the addition of an assist, the assist may be hydraulic, mechanical, electrical or other method.

Locking mechanism 110 may be a powered locking mechanism; e.g., it may include an electro-mechanical arrangement that may include one or a plurality of electromagnets. The electro-mechanical arrangement may be configured to release and/or pin 130 or other components of a wheel stopping mechanism, e.g., locking mechanism 110. In some embodiments of the invention a mechanism may pull wheel 40 upward into one or a plurality of inner hollows 25, e.g. retracting wheel 40, wherein the lower end of the tube 30 may interface with the ground when wheel 40 retracts, such that frictional and/or other forces will prevent the crutch from moving in a first and/or additional directions.

A processing unit 180 is coupled to the motorized exoskeleton system. Processing unit 180 may be physically coupled to motorized exoskeleton system. In some embodiments of the invention, processing unit 180 may be coupled via a wireless communication the motorized exoskeleton system.

Processing unit 180 may control, manipulate, sense or otherwise interact with one or a plurality of mechanisms within crutch 20, including, engaging a wheel stopping mechanism, e.g., locking mechanism 110 in response to inputs from sensors 170 and/or other sensors or other data. Processing unit 180 may serve to modify the locomotion of the crutch over the surface and/or interact with components of motorized exoskeleton system modify the locomotion of the crutch over the surface.

Processing unit 180 may be coupled to crutch 20, motorized exoskeleton 10 and/or other components of motorized exoskeleton system 5. Processing unit 180 may provide an interface between crutch 20 and motorized exoskeleton 10 or other components of motorized exoskeleton system 5. Processing unit 180 may be employed to configure limiter 80 either automatically or semi-automatically. Processing unit 180 may be configured to interact with handle 70 and or one or a plurality of interfaces 90.

Figure 2B:
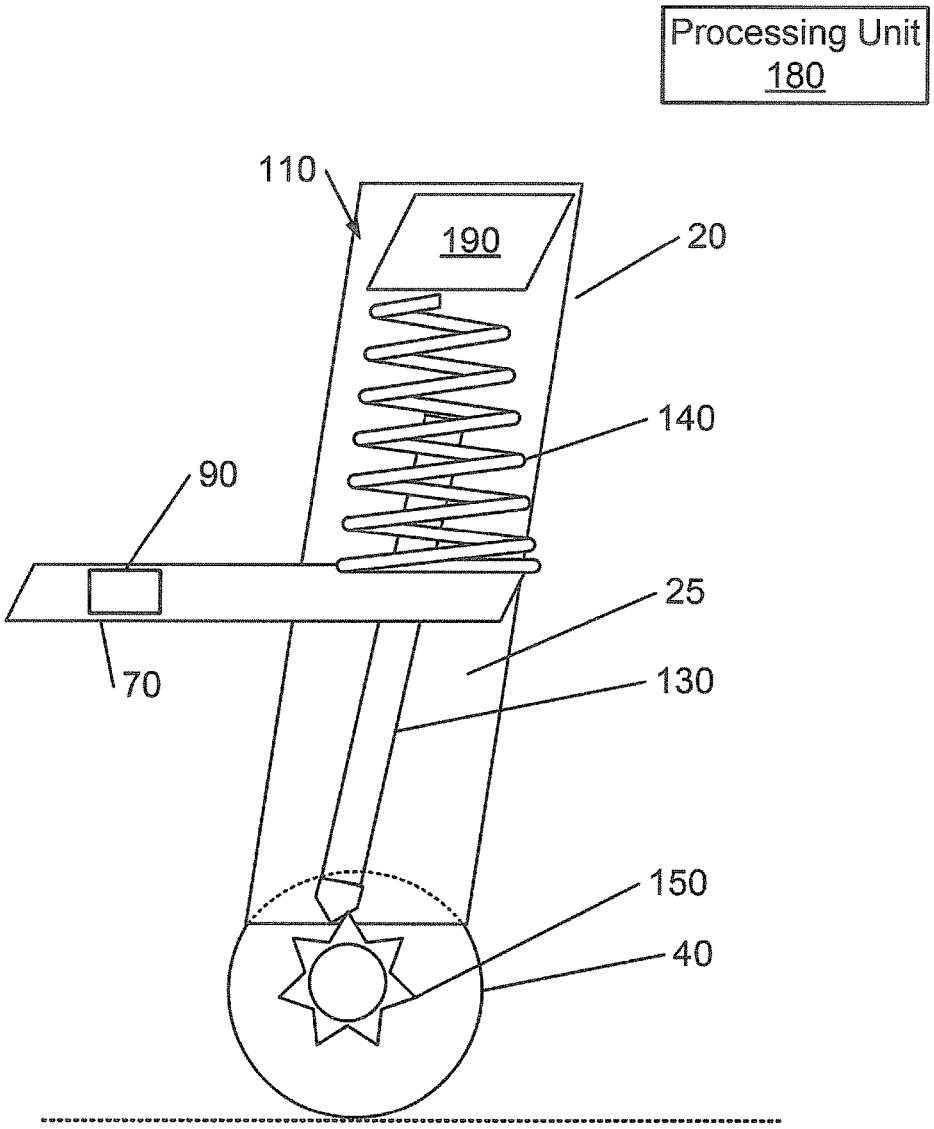
FIG. 2B is a schematic illustration depicting a side view of a crutch containing a handle and a motorized braking/release mechanism within a motorized exoskeleton system, according to an embodiment of the present invention.

FIG. 2B is a schematic illustration a crutch containing a handle and a motorized braking/release mechanism within a motorized exoskeleton system, according to an embodiment of the present invention.

The motorized exoskeleton device may be an exoskeleton gait device. In some embodiments of the invention, one or a plurality of handles 70 may mechanically, or in some embodiments of the invention, semi-mechanically shifted to an up and/or down position.

One or a plurality of handles 70 may mechanically, or in some embodiments of the invention, semi-mechanically shifted to a forward and/or backward position.

Handle 70 includes interfaces 90. Interfaces 90 may be buttons or touch sensitive locations that may control one or a plurality of components within motorized exoskeleton system 5.

Crutch 20 includes a locking mechanism 110. Locking mechanism 110, e.g., a wheel lock and/or release mechanism may prevent the crutch from moving beyond a particular location, e.g., moving further in a particular direction by limiting the rotation of wheels 40. In some embodiments of the invention, locking mechanism 110 may prevent the one or a plurality of devices configured to interact with a surface, e.g., wheels 40, from allowing crutch 20 to move.

In some embodiments of the invention, another component within the motorized exoskeleton system may control the locking mechanism 110. Locking mechanism 110 may be mechanical, electrical, via hydraulics and/or other methods.

One or a plurality of wheels 40 has its rotation bounded, in some embodiments of the invention, by a ratchet 150 or similar mechanism, e.g., on an axle of wheel 40. The bounding of the rotation of wheel 40 may limit the ability of wheel 40 to rotate in the opposite direction of a desired direction of travel and/or locomotion of the user. The bounding of the rotation of wheel 40 may serve to modify the locomotion of the crutch over the surface.

The bounding of the rotation of wheel 40 may be overridden by the user. In some embodiments of the invention, the bounding of the rotation of wheel 40 may be overridden by mechanical, electrical, hydraulic or other means.

A control switch, button, or other interface to override the bounding of the rotation of wheel 40 may be located in a component of motorized exoskeleton system 5. The control switch, button, or other interface to override the bounding of the rotation of wheel 40 may be located in a component outside of motorized exoskeleton system 5. The control switch, button, or other interface to override the bounding of the rotation of wheel 40 may be located in a component of crutch 20. A control switch, button, or other interface to override the bounding of the rotation of wheel 40 may be located in handle 70. Inner hollow 25 of crutch 20 may contain locking mechanism 110 for wheel 40.

Locking mechanism 110 includes a mechanics-based arrangement wherein a pin 130, e.g., a spindle, may slide up or down, the sliding up and down configured to be a component of the braking system.

Pin 130 may be pushed down by a spring 140 and/or other mechanisms, and lifted by shifting handle 70 upward. The lifting may release the locking mechanism engaged by pin 130.

Lifting of handle 70 may be done manually, mechanically, and or with the addition of an assist, the assist may be hydraulic, mechanical, electrical or other method.

Locking mechanism 110 may include an electro-mechanical arrangement that may include one or a plurality of electromagnets. The electro-mechanical arrangement may be configured to release and/or pin 130 or other components of a wheel stopping mechanism, e.g., locking mechanism 110.

In some embodiments of the invention, an electro-mechanics system may include a motor 190 that slides pin 130 up and/or down.

A mechanism may pull wheel 40 upward into one or a plurality of inner hollows 25, e.g. retracting wheel 40, wherein the lower end of the tube 30 may interface with the ground when wheel 40 retracts, such that frictional and/or other forces will prevent the crutch from moving in a first and/or additional directions.

Figure 2C:
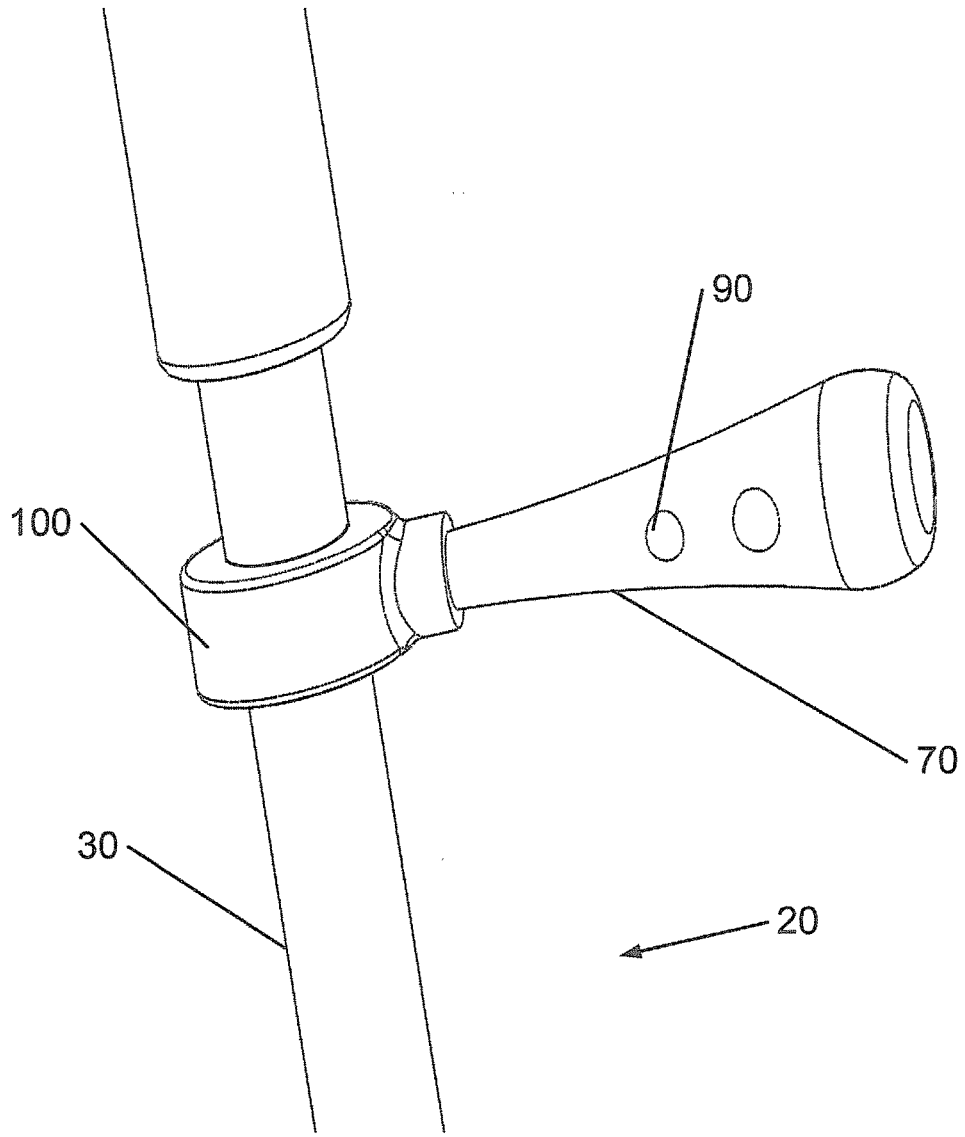
FIG. 2C is a schematic illustration of a handle on a crutch within a motorized exoskeleton system, according to an embodiment of the present invention.

FIG. 2C is a schematic illustration of a handle within a system that includes an exoskeleton gait device and crutches.

Handle 70 is coupled to crutch 20 via a ring 100. Ring 100 is on tube 30. Ring 100 may include, or may be coupled to sensitive strain gauges. In some embodiments of the invention, the sensitive strain gauges may allow the user to apply less than enough pressure to move handle fully forward, backward, upward and/or downward and still control crutch 20.

Handle 70, or interfaces thereon, may be configured to control locking mechanism 110.

In some embodiments of the invention, a user may apply a force to the handle. The force may be upwards, downwards or in another direction. The user may apply a force in a combination of one or a plurality of directions. The user's application of force may result in the control of locking mechanism 110 or other methods of controlling wheel 40.

In some embodiments a user may interact with an interface 90 on handle 70. Handle 70 may be mechanically coupled to lock mechanism 110 or other methods of controlling wheel 40. The interaction with the interface may engage or disengage lock mechanism 110 and/or other methods of controlling wheel 40.

In some embodiments of the invention, a signal may be sent wirelessly or via wired connections from another component within motorized exoskeleton system 5 or from outside of motorized exoskeleton system 5.

Figure 3A:
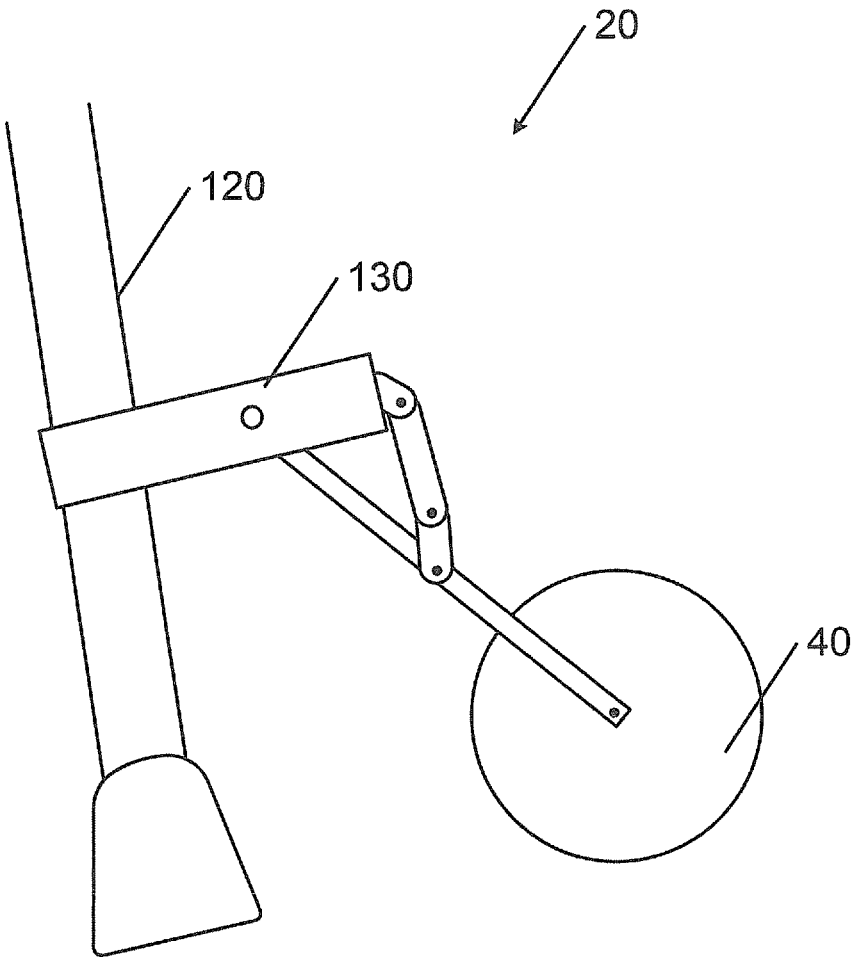
FIG. 3A is a schematic illustration of a wheel on a crutch within a system that includes an exoskeleton gait device and crutches, according to an embodiment of the invention.

FIG. 3A is a schematic illustration of a wheel on a crutch within a system that includes an exoskeleton gait device and crutches, according to an embodiment of the invention.

One or a plurality of wheels 40, a braking mechanism and/or a locking mechanism are located outside of a body 120 of crutch 20, e.g., on the outer surface of crutch 20. A member 130 is coupled to body 120 of crutch 20. Member 130 is configured to fold and/or unfold wheel 40 and or other components, wherein the folding and/or unfolding of wheel 40 may result in the same consequence as engaging locking mechanism 110. In some embodiments of the invention, other components may be used to fold and or otherwise manipulate wheel 40. The braking mechanism may serve to modify the locomotion of the crutch over the surface.

Figure 3B:
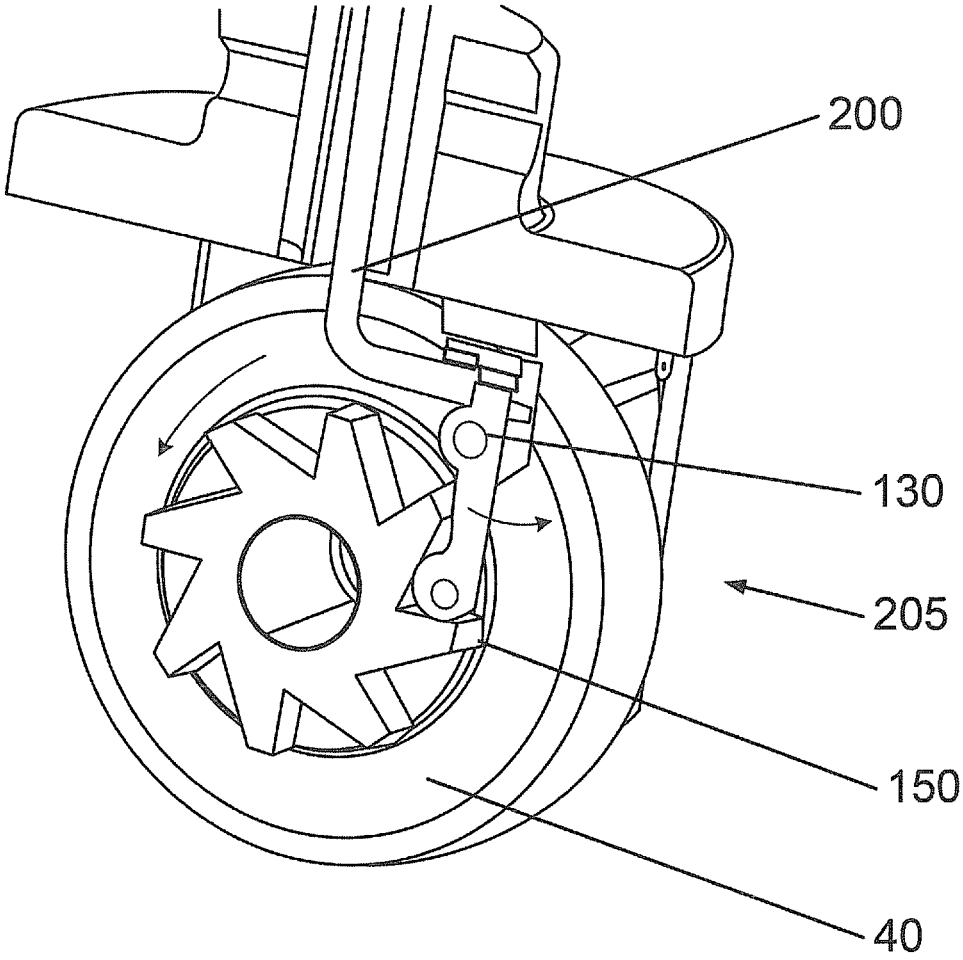
FIG. 3B is a schematic illustration of a wheel on a crutch within a system that includes an exoskeleton gait device and crutches, according to an embodiment of the invention.

FIG. 3B is a schematic illustration of a wheel on a crutch within a system that includes an exoskeleton gait device and crutches, according to an embodiment of the invention.

One or a plurality of wheels 40 are coupled to crutch 20. A braking system 205 is coupled to wheel 40. Braking system 205 may be activated by a mechanical, electrical or other means. Braking system 205 may be connected to a handle or other device (heretofore handle), configured to interact with a user of an motorized exoskeleton system or other system. Braking system is connected to the handle via a cable 200. Cable 200 may provide communication between pin 130 and the handle. Pin 130 interacts with ratchet 150 to lock or providing a braking force on wheel 40. The braking system may serve to modify the locomotion of the crutch over the surface.

Figure 3C:
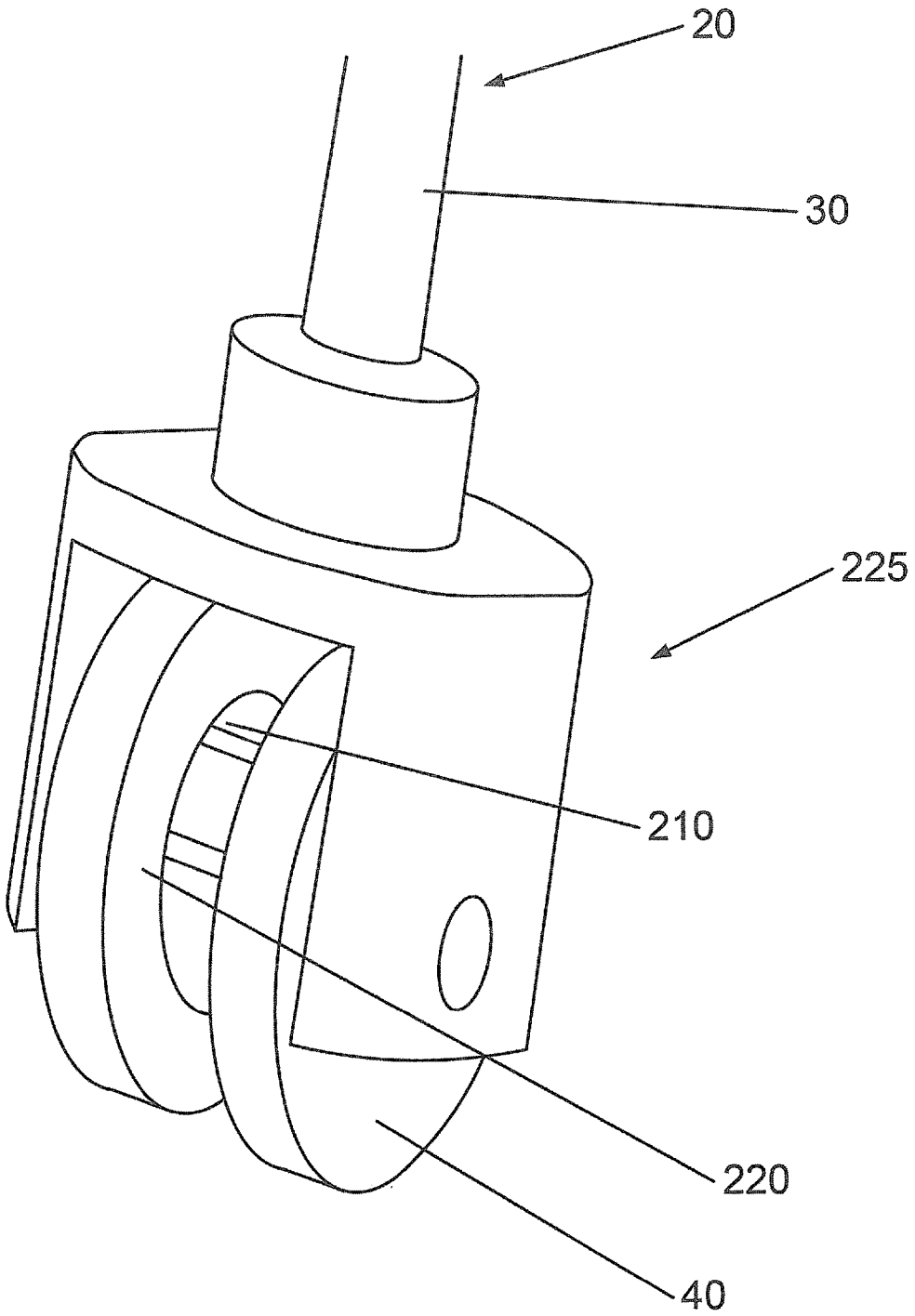
FIG. 3C is a schematic illustration of a wheel on a crutch within a system that includes an exoskeleton gait device and crutches, according to an embodiment of the invention.

FIG. 3C is a schematic illustration of a wheel on a crutch within a system that includes an exoskeleton gait device and crutches, according to an embodiment of the invention. One or a plurality of wheels 40 are coupled to crutch 20. Wheel 40 may be coupled to tube 30 on crutch 20. In some embodiments of the invention, one or a plurality of wheel 40 may be coupled to other components of crutch 20. Wheel 40 may be a component within wheel system 225. Wheel system 225 includes a motor 210. Motor 210 may provide sufficient torque to facilitate the turning of a motorized exoskeleton device. In some embodiments of the invention, sufficient torque may allow wheels 40 on a first crutch 20 to move faster or with greater power than wheels 40 on a second crutch 20. In some examples, wheels 40 on the second crutch 20 may not move at all resulting in a pivot. Like a tank or similar tracked vehicles, this may result in the turning or pivoting of the user or the motorized exoskeleton device. Other mechanisms may also allow for the user to turn or pivot, including Controlled Differential Steering, Double Differential Steering, Braked Differential Steering or other methods.

Motor 210 may be configured to rotate wheels 40 in response to a signal from a user. A signal from a user may include an interaction with a handle coupled to crutch 20. Motor 210 may be electrical, electromagnetic, pneumatic or powered and/or activated by other sources of energy. Motor 210 may be configured to compensate for an imbalance of strength wherein a right side of the user could have a different level strength than a left side of the user. The imbalance resulting in a first crutch 20 being pushed further than a second crutch 20. Motor 210 may compensate for the imbalance, for example, by moving a wheel 40 such that a first crutch 20 moves a similar distance as a second crutch 20. Motor 210 may allow user to use crutches without a connecting member, the connecting member, for examples, as described herein. Motor 210 may be coupled to a processing unit, the processing unit, for example, as described herein. The processing unit may be a component of a motorized exoskeleton system. The processing unit may be a component of crutches 20. Processing unit may be external to motorized exoskeleton system, Processing unit may be a component of a motorized exoskeleton device.

Wheel system 225 includes brakes 220. Brakes 220 may be part of a braking mechanism and/or braking system. The mechanism may be an electrical brake mechanism, a mechanical brake mechanism, an electromagnetic brake mechanism, a pneumatic brake mechanism, or a mechanism powered and/or activated by other sources of energy. Brakes 220 may be sufficient to stop and limit the rotation of wheels 40.

Figure 4A:
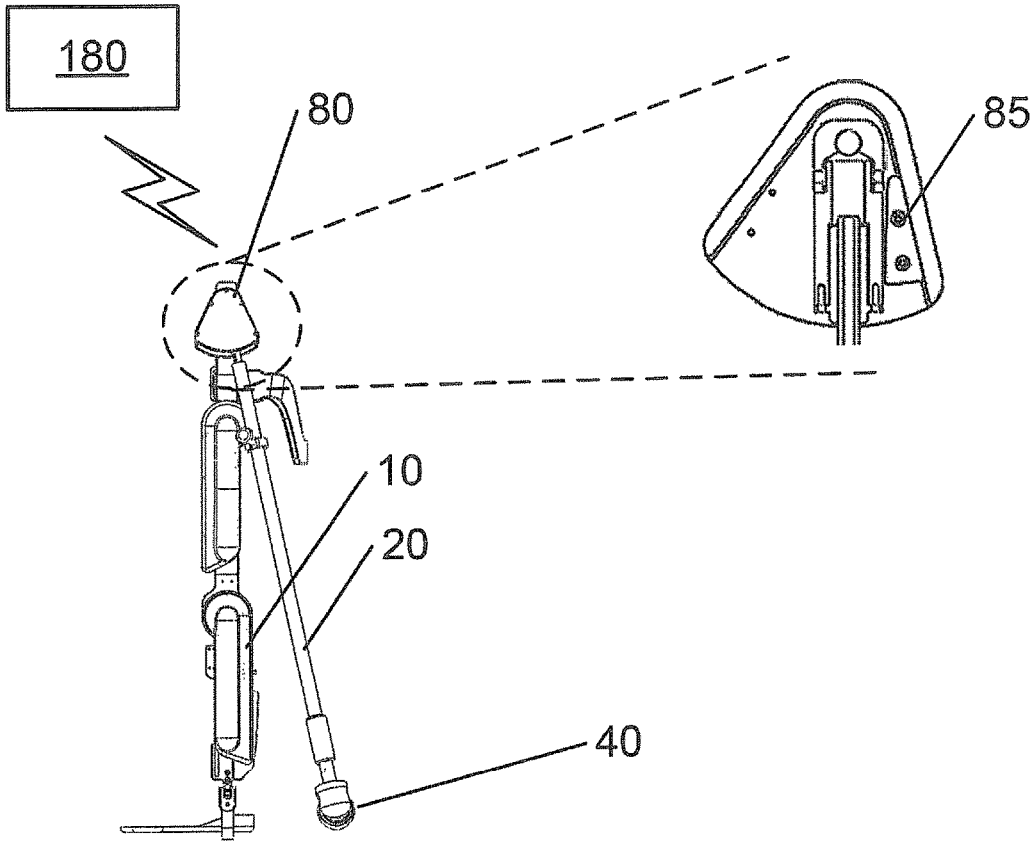
FIG. 4A is a schematic illustration of a limiter coupled to a crutch, within a system that includes an exoskeleton gait device and crutches, according to an embodiment of the invention.

FIG. 4A is a schematic illustration of a limiter coupled to a crutch, within a system that includes an exoskeleton gait device and crutches, according to an embodiment of the invention.

A limiter 80, for example, as described above, is coupled to crutch 20. Limiter 80 has a plurality of screws 85. screws 85 may be configured, and/or calibrated to set a limit on the angle of movement of crutch 20. Limiter 80 is in communication with a processing unit, for example, processing unit 180. The processing unit may be configured to electrically, magnetically, electromagnetically or otherwise set and maintain a limit of angular motion on limiter 80. In some embodiments of the invention, a switch, for examples a mechanical, optical, or magnetic switch, may be configured to sense that crutch 20 has hit the limit of angular motion, as maintained by limiter 80 and communicate with a braking system and/or brakes to stop or limit the movement of wheels coupled to crutches 20.

Figure 4B:
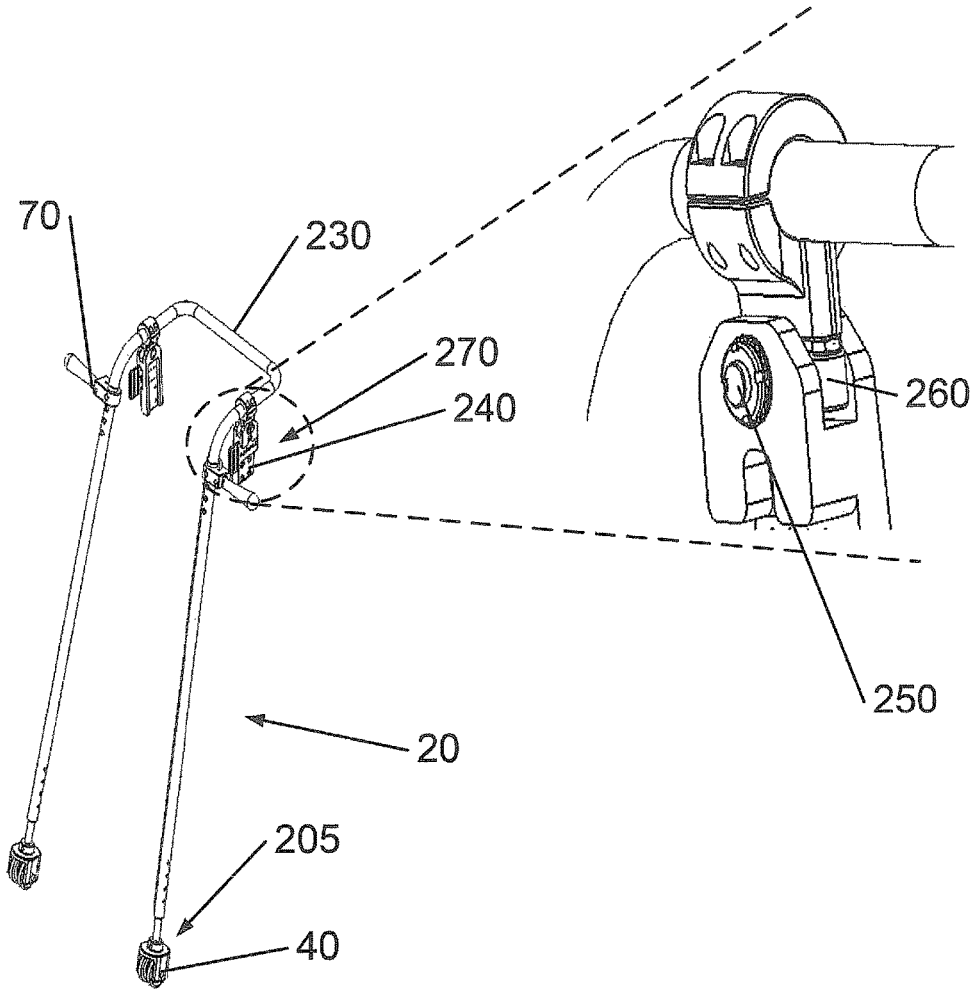
FIG. 4B is a schematic illustration of a limiter coupled to a crutch, within a system that includes an exoskeleton gait device and crutches, according to an embodiment of the invention.

FIG. 4B is a schematic illustration of a limiter coupled to a crutch, within a system that includes an exoskeleton gait device and crutches, according to an embodiment of the invention.

Crutches 20 are coupled to each other via a coupling member 230. Coupling member 230 may be a tube and may be constructed from similar or different materials than crutches 20.

Coupling member 230 may be rigid. Coupling member 230 may be constructed from a single tube. Coupling member maybe constructed from multiple components that combined couple crutches 20 to each other. Coupling member may expand, contract, or otherwise change its shape and configuration in an adaption to different environments, In some embodiments of the invention, coupling member 230 may change shape when a user sits down or when a user gets up to adjust for differences in comfortably between sitting and standing positions. Coupling member 230 may include at least two components that are separatable and attachable such that a user can easily begin or end using crutches 20 that are coupled together. Coupling member 230 may be a single tube or tube like structure.

Coupling member 230 may provide sufficient rigidity to prevent a first crutch 20 from moving substantially ahead of a second crutch 20.

Coupling member 230 is coupled directly or indirectly to limiter unit 270. Limiter unit 270 includes bolt 250. Bolt 250 may be made from rubber and/or other materials. Bolt 250 may be configured to limit the angular motion of crutches 20.

A sensor 260 may be configured to communicate with processing unit 180 or another processing unit, e.g., a processing unit in crutches 20 when crutches 20 reach a maximum angular motion. Maximum angular motion may be changed depending on environmental conditions or conditions of a user. Maximum angular motion may be changed, controlled or optimized automatically, semi automatically and/or manually.

Sensor unit may communicate with wheels 40 braking system 205 and/or brakes to stop, alter or inhibit motion of wheels 40 given an angular motion of a first and/or second crutch 20.

In some embodiments of the invention, sensor 240 may be coupled to a microswitch. The microswitch may be operated via mechanical, optical and/or magnetic means. The microswitch may be configured to interface with brakes described herein.

Limiter unit 270 includes a motor unit 240. Motor unit 240 may be configured to move crutches in an upwards and/or downwards direction. Motor unit 240 may be configured to move crutches in a forward and/or backward direction. Motor unit 240 may interface with a motor unit coupled to wheels 40. Motor unit may automatically or semi-automatically control, inhibit or provide angular motion of crutches 20.

Handles 70 may be configured to provide an interface to interact with motor unit 240, limiter unit 270, sensor unit 260, braking system 205 and or other components of crutch 20. Handles 70 may be configured to interface with processing unit 180 and/or other processing units.

Figure 5A:
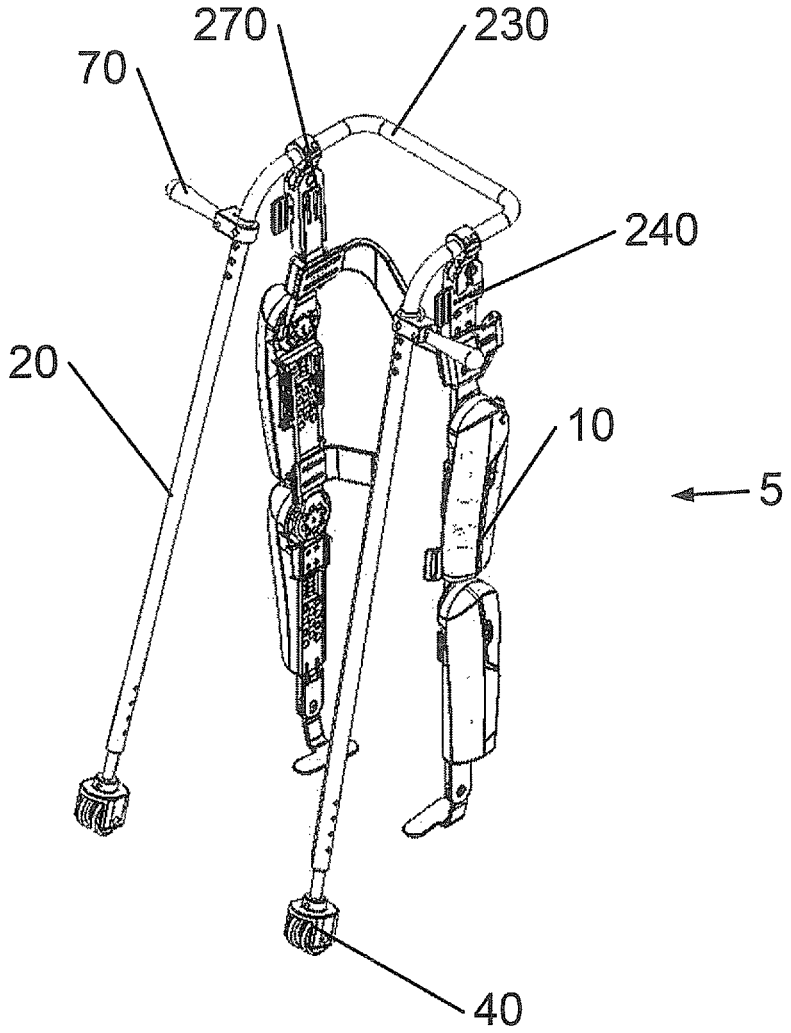
FIG. 5A is a schematic illustration of a crutch coupled to an motorized exoskeleton unit, or a portion thereof, according to an embodiment of the invention.

FIG. 5A is a schematic illustration of a crutch coupled to an motorized exoskeleton unit, or a portion thereof, according to an embodiment of the invention.

In some embodiments of the invention, crutches 20 are coupled to coupling device 230. Limiter 270 is coupled to coupling device 230. Limiter 270 is coupled to motorized exoskeleton device 10 or components thereof. The coupling of motorized exoskeleton device 10 or components thereof and limiter 270 may be configured to allow a user to let go of crutch 20 without crutches 20 falling.

The coupling of motorized exoskeleton device 10, or components thereof, and limiter 270 may be configured to allow communication between motorized exoskeleton device 10 and crutch 20 and components thereof, including but not limited to wheels 40, handle 70, braking system 205, motor unit 240 and/or other components of crutch 20.

The coupling of motorized exoskeleton device 10, or components thereof, and limiter 270 may be configured to allow motorized exoskeleton device to stand freely. Standing free, motorized exoskeleton device 20 may facilitate the integration of motorized exoskeleton device 10 and a user. Motor unit 240 and/or other components of motorized exoskeleton system 5 may be configurable automatically, semi-automatically or manually to facilitate the integration of motorized exoskeleton device 10 and a user. In some embodiments of the invention, crutches 20 may telescope up and/or down to facilitate integration of motorized exoskeleton device 10 and a user.

In some examples, handles 70 may move along crutch 20, or components thereof, in an upwards and/or downwards direction. The movement of handles 70 in an upwards and/or downwards direction may be automatically controlled, semi-automatically controlled or manually controlled. The movement of handles 70 in an upwards and/or downwards direction may be facilitated by motors within or coupled to crutches 20. The movement of handles 70 in an upwards and/or downwards direction may facilitated the raising of a user from a sitting to a standing position.

Figure 5B:
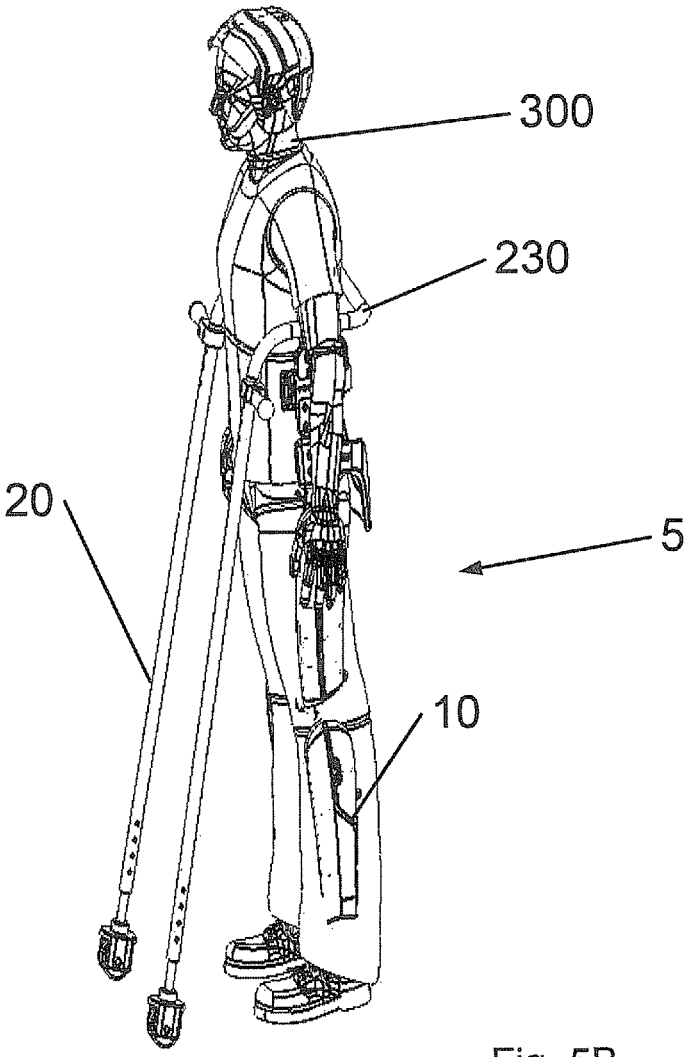
FIG. 5B is a schematic illustration of a user interfacing with a motorized exoskeleton system according to an embodiment of the invention.

FIG. 5B is a schematic illustration of a user interfacing with a motorized exoskeleton system according to an embodiment of the invention.

User 300 may use crutches 20 and motorized exoskeleton device 10 to support himself and facilitate locomotion.

Coupling member 230 may be configured to provide support to user 300 and in some embodiments of the invention, maintain communication and facilitate coordination between crutches 20.

Figure 5C:
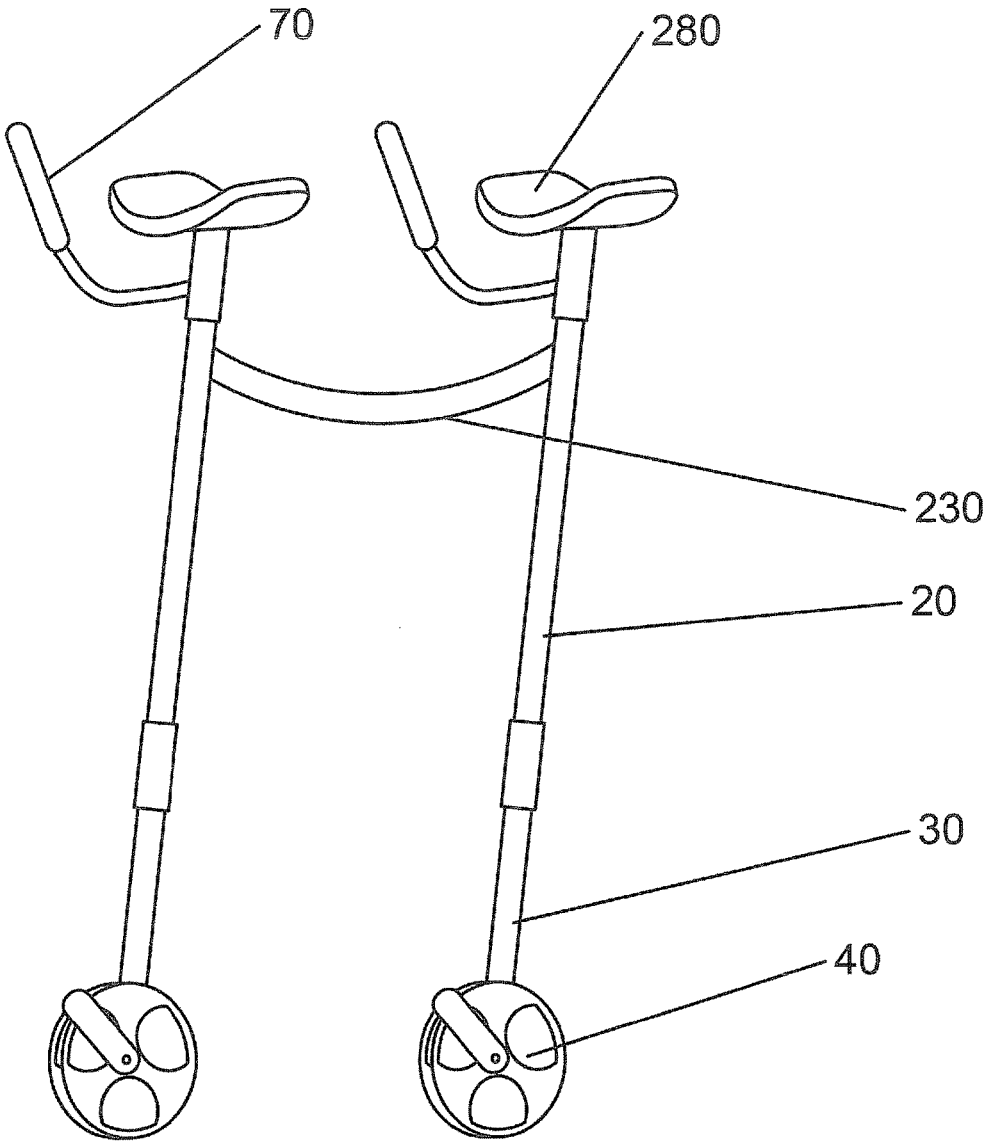
FIG. 5C is a schematic illustration of a crutch for use in a motorized exoskeleton system, according to an embodiment of the invention.

FIG. 5C is a schematic illustration of a crutch for use in a motorized exoskeleton system, according to an embodiment of the invention.

Crutch 20 includes upward extending handles 70. Handles 70 may have interfaces described above. Crutch 20 has an arm and/or wrist support 280.

A coupling unit 230 couples crutches 20 together, as described above. Coupling unit 230 may provide interfaces for coupling components of motorized exoskeleton system including, motorized exoskeleton device.

Figure 6:
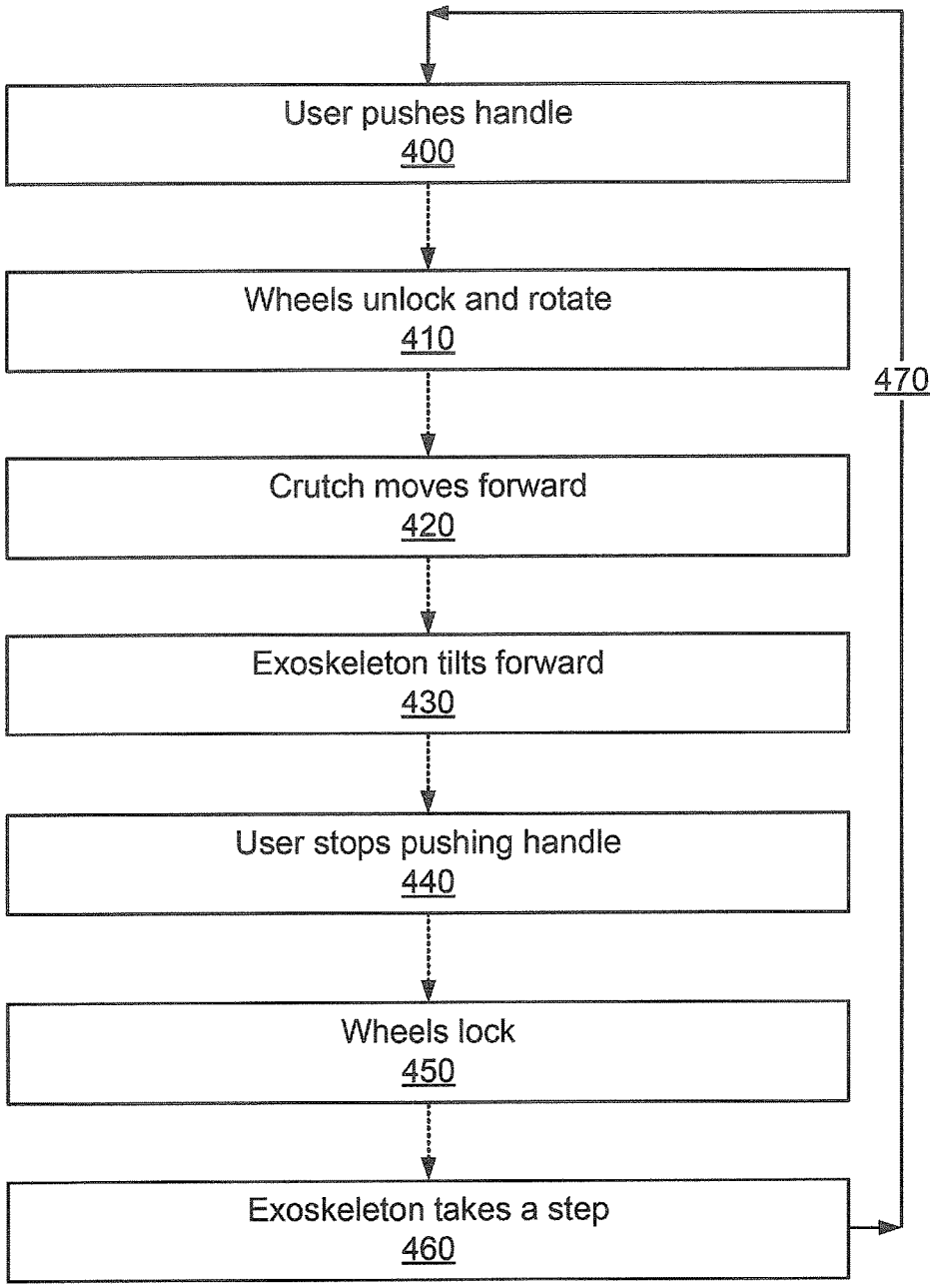
FIG. 6 is a schematic illustration of a method for using a motorized exoskeleton device and crutches, according to an embodiment of the invention.

FIG. 6 is a schematic illustration of a method for using a motorized exoskeleton device and crutches, according to an embodiment of the invention.

References are made herein to systems, devices, units and components that are also described, for example, above.

The schematic illustration depicts both the actions by a user and the result of those actions vis-à-vis the motorized exoskeleton system. In some embodiments of the invention a user employing crutch 20 and motorized exoskeleton device 10 and/or other components of motorized exoskeleton system 5 may push crutch 20 forward using handles 70, and/or a component of handles 70, e.g., interfaces 90.

In some embodiments of the invention, the user may simultaneously push one or a plurality of handles 70 upward or in one or a plurality of other directions, this portion of the method depicted as box 400.

As a direct or indirect result of the user maneuvering one or a plurality of crutches 20, one or a plurality of wheels 40 may be unlocked and are able to rotate, depicted as box 410.

As a direct or indirect result of the one or plurality of wheels becoming unlocked and allowed to rotate, crutch 20 moves forward, depicted as box 420. In some embodiments of the invention, the extent that crutch 20 moves forward may be limited by limiter 80.

As a direct or indirect result of the one or plurality of wheels becoming unlocked and allowed to rotate, and crutch 20 moving forward, motorized exoskeleton device 10 tilts forward, depicted as box 430.

In some embodiments of the invention, the user may stop the crutches from moving further forward by not applying a force to handles 70, or a component thereof, and/or by interfacing or stopping to interface with interface 90, depicted as box 440.

As a direct or indirect result of the user stopping the crutches from moving further forward by not applying a force to handles 70, or a component thereof, and/or by interfacing or stopping to interface with interface 90, one or a plurality of wheels 40 may be locked and limited and/or prevented from rotating further, depicted as box 450.

Simultaneously, or closely following the step of box 450, and as a direct and/or indirect result of the motorized exoskeleton device 10 tilting forward, a sensor, e.g., a tilt sensor may signal the motorized exoskeleton device 10, or a component thereof to take a step, as depicted in box 460.

A user may be able to step backwards by interfacing with handle 70. In some embodiments of the invention, the interface with handle 70 may be through interface 90. Interface with handle 70 may be via pressing one or a plurality of handles 70 in a backwards direction.

The method of use by the user and the resulting actions of the motorized exoskeleton system 5 may repeat iteratively, as depicted by arrow 470.

Figure 7A:
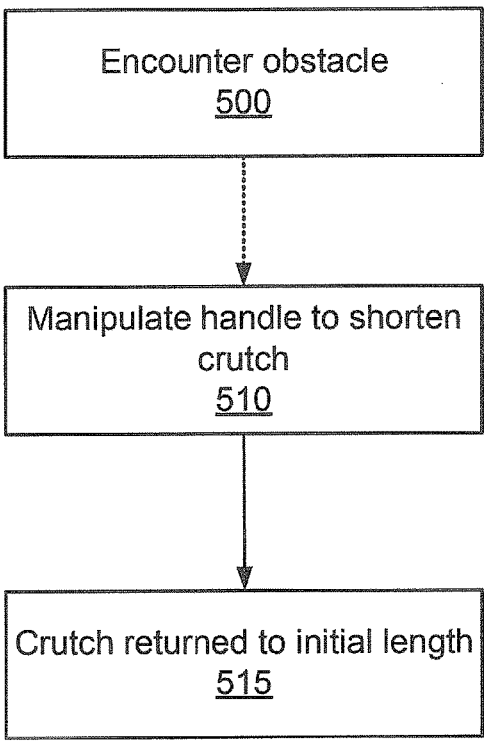
FIG. 7A is a schematic illustration of a method for using a motorized exoskeleton device and crutches for ascending or descending on stairs, curbs, or for use on other non-level surfaces, according to an embodiment of the present invention.

FIG. 7A is a schematic illustration of a method for using a motorized exoskeleton device and crutches for ascending or descending on stairs, curbs, or for use on other non-level surfaces.

References are made herein to systems, devices, units and components that are also described, for example, above.

In some embodiments of the invention, crutch 20 may be extendable in length, e.g., telescopic, to allow the use of motorized exoskeleton system 5 to ascend or descend stairs, curbs and or other non-level surfaces. Crutch 20 may include one or a plurality of telescoping components.

A user may encounter an obstacle, depicted as box 500. Intending to overcome the obstacle may requires him to go up may ascend the obstacle by shortening one or a plurality of a crutch 20 that are enabled to shorten via a telescopic design. The shortening of crutch 20 may be via motor 190 or similar devices, e.g., as described above. In some embodiments of the invention a user may shorten one or a plurality of crutches 20 via a methodology that does not require telescopically designed crutch 20.

The user may shorten one or a plurality of crutches 20 by interfacing with handle 70, as depicted by box 510. Sensors in motorized exoskeleton system 5 may automatically or semi-automatically shorten and/or lengthen one or a plurality of crutches as a result of data provided by the sensors 170, the sensors may be in crutch 20, or may be associated with another component of motorized exoskeleton system 5.

In examples wherein the user may shorten one or a plurality of crutches 20 by interfacing with handle 70, the user may interface with handle 70 by interacting with interface 90. The user may interface with handle 70 by pulling handles 70 upwards, the pulling of handles 70 upward may be to a greater degree than employed by the user when pulling handles 70 upward to disengage lock mechanism 110.

The user may return one or a plurality of crutches 20 to a length similar to the length of crutch 20 prior to its shortening, or to a different length, by interfacing with handle 70, as depicted by box 515.

Figure 7B:
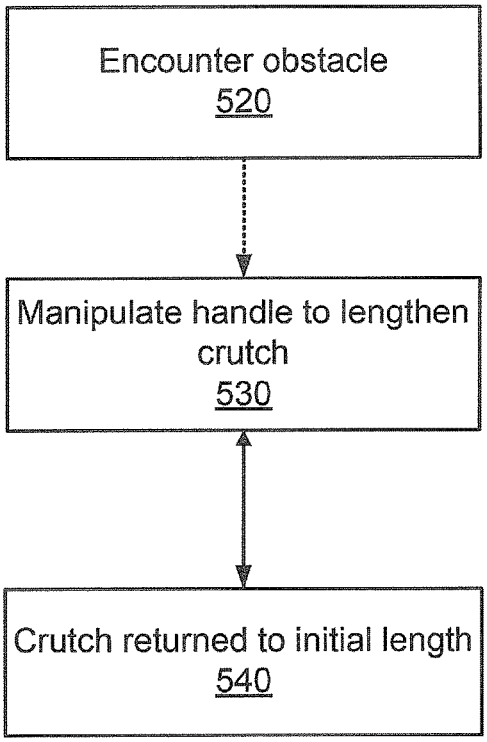
FIG. 7B is a schematic illustration of a method for using a motorized exoskeleton device and crutches for ascending or descending on stairs, curbs, or for use on other non-level surfaces, according to an embodiment of the present invention; and, FIG. 8 is a schematic illustration of a method for using a motorized exoskeleton device and crutches, according to an embodiment of the invention.

FIG. 7B is a schematic illustration of a method for using a motorized exoskeleton device and crutches for ascending or descending on stairs, curbs, or for use on other non-level surfaces.

In some embodiments of the invention, a user, intending to overcome an obstacle that requires him to go down, may descend the obstacle by lengthening one or a plurality of a crutch 20 that are enabled lengthen via a telescopic design, as depicted as box 520. A user may lengthen one or a plurality of a crutch 20 via a methodology that does not require telescopically designed crutch 20.

The user may lengthen one or a plurality of crutches 20 by interfacing with handle 70, as depicted as box 530. In some embodiments of the invention, sensors in motorized exoskeleton system 5 may automatically or semi-automatically shorten and/or lengthen one or a plurality of crutches as a result of data provided by the sensors 170, the sensors may be in crutch 20, or may be associated with another component of motorized exoskeleton system 5. The user may return one or a plurality of crutches 20 to a length similar to the length of crutch 20 prior to its lengthening, or to a different length, by interfacing with handle 70, as depicted by box 540.

In examples wherein the user may lengthen one or a plurality of crutches 20 by interfacing with handle 70, the user may interface with handle 70 by interacting with interface 90. In some embodiments of the invention, the user may interface with handle 70 by pulling or pushing handle 70 downwards.

In some embodiments of the invention, wherein a user may unexpectedly come across an obstacle that requires them to ascend or descend, sensors 170 and/or other sensors within motorized exoskeleton system 5 may automatically or semi-automatically lengthen or shorten one or a plurality of crutches 20.

Sensors 170 and/or other sensors may be configured to sense obstacles such as holes, steps, rocks, and or other obstacles that may necessitate a change in locomotion or direction of the gait system or other action by crutches 20 and/or other components of motorized exoskeleton system 5.

Figure 8:
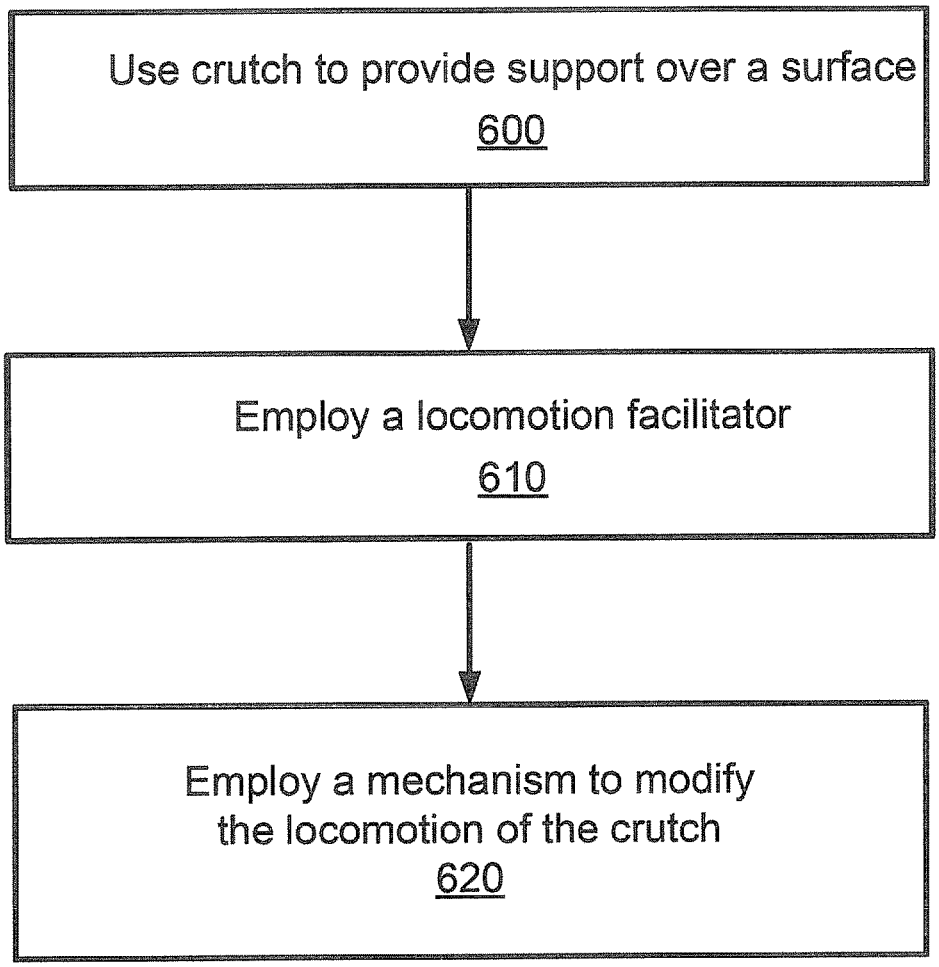

FIG. 8 is a schematic illustration of a method for using a motorized exoskeleton device and crutches, according to an embodiment of the invention.

A method for the use of gait device for facilitating the locomotion of a person over a surface includes employing a crutch to provide support over the surface to the person using the gait device, as depicted as box 600.

In some embodiments the surface may be the ground, or a floor. In some embodiments the gait device may be an exoskeleton device, including a motorized exoskeleton device, reciprocating gait orthsosis based devices and other devices.

In some embodiments of the invention a person may need their locomotion facilitated when the person has a disability, including paraplegics and quadriplegics.

Box 610 depicts the employing of a locomotion facilitator to enhance locomotion of the crutch over the surface.

In some embodiments of the invention, a locomotion facilitator may include wheels, or other objects or devices that may lessen the friction between the crutch and the surface.

Box 620 depicts the employing a mechanism to modify the locomotion of the crutch over the surface.

In some embodiments of the invention, a mechanism to modify the locomotion of the crutch over the surface, may include a brake, for example, as describe above, a brake system and/or other mechanisms whereby the friction between the crutch and the surface, either directly or via a locomotion facilitator is increased. In some embodiments of the invention, the friction may be increased until the crutch stops, or becomes difficult to move forward.

Examples of the present invention may include apparatuses for performing the operations described herein. Such apparatuses may be specially constructed for the desired purposes, or may comprise computers or processors selectively activated or reconfigured by a computer program stored in the computers. Such computer programs may be stored in a computer-readable or processor-readable non-transitory storage medium, any type of disk including floppy disks, optical disks, CD-ROMs, magnetic-optical disks, read-only memories (ROMs), random access memories (RAMs) electrically programmable read-only memories (EPROMs), electrically erasable and programmable read only memories (EEPROMs), magnetic or optical cards, or any other type of media suitable for storing electronic instructions. It will be appreciated that a variety of programming languages may be used to implement the teachings of the invention as described herein. Examples of the invention may include an article such as a non-transitory computer or processor readable non-transitory storage medium, such as for example, a memory, a disk drive, or a USB flash memory encoding, including or storing instructions, e.g., computer-executable instructions, which when executed by a processor or controller, cause the processor or controller to carry out methods disclosed herein. The instructions may cause the processor or controller to execute processes that carry out methods disclosed herein.

Different embodiments are disclosed herein. Features of certain embodiments may be combined with features of other embodiments; thus certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A system comprising:

a motorized gait device for facilitating a gait of a person over a surface;

two crutches, separate from the motorized gait device and configured to be mechanically coupled to the motorized gait device via a limiter; and a processing unit configured to set and/or maintain a limit on angular motion on the limiter, the crutches being manipulable to move forward or backward through an angular range that is limited by the limiter, the two crutches being coupled to one another to prevent substantially different forward or backward motions of the two crutches, the crutches comprising a locomotion facilitator to enhance locomotion of the crutches over the surface and a mechanism to modify the locomotion of the crutches over the surface.

2. The system of claim 1, wherein a crutch of said two crutches further comprises a manipulatable handle.

3. The system of claim 2, wherein the manipulatable handle is configured to facilitate the modification of the locomotion of the crutches over the surface.

4. The system of claim 1, wherein the locomotion facilitator comprises a wheel.

5. The system of claim 1, wherein the locomotion facilitator is retractable.

6. The system of claim 1, wherein the locomotion facilitator comprises a motor.

7. The system of claim 1, wherein the mechanism to modify the locomotion of the crutches over the surface is selected from the group of mechanisms consisting of a mechanical mechanism having a pin and a ratchet, a mechanical brake mechanism, an electromagnetic brake mechanism, a pneumatic brake mechanism, and an electrical brake mechanism.

8. The system of claim 1, wherein the gait device comprises a motorized exoskeleton device.

9. The system of claim 1, wherein a length of a crutch of said two crutches is modifiable in response to a change in an environment.

10. The system of claim 1, wherein the processing unit is further configured to control the mechanism to modify the locomotion of the crutches over the surface.

11. A system comprising:

a motorized exoskeleton device for facilitating a gait of a person over a surface, the exoskeleton device including a motorized brace system configured to be attached to a lower limb of the person;

a crutch configured to be mechanically coupled to the motorized exoskeleton device via a limiter, the crutch including a manipulatable handle configured to provide the person control over operation of the crutch and/or the exoskeleton, and a processing unit configured to set and/or maintain a limit on angular motion on the limiter.

12. The system of claim 11, further comprising the limiter configured to limit an angular motion of the crutch.

13. The system of claim 11, wherein the crutch further includes a braking mechanism configured to modify locomotion of the crutch over the surface.

14. The system of claim 11, wherein the manipulatable handle provides the person control over operation of the crutch and/or the exoskeleton via an interface configured to facilitate interaction of the person with one or more of a locking mechanism, a sensor unit, a braking system, a motor unit configured to move the crutch, the processing unit, and the limiter.

15. The system of claim 11, further comprising a sensor unit configured to sense and communicate with the processing unit when an angular motion of the crutch reaches a maximum angular motion.

16. The system of claim 11, wherein a maximum angular motion of the crutch set by the limiter is adjustable based on an environmental condition and/or a condition of the person.

17. The system of claim 11, wherein a coupling of the limiter to the motorized exoskeleton device allows the motorized exoskeleton device to stand freely.

18. A method comprising:

facilitating a gait of a person over a surface using a motorized gait device; and providing two crutches to provide support over the surface to the gait device, the two crutches:

being separate from the motorized gait device and configured to be mechanically coupled to the gait device via a limiter, being manipulable to move forward or backward through an angular range that is limited by the limiter, being coupleable to one another to prevent substantially different forward or backward motions of the two crutches, and comprising a locomotion facilitator to enhance locomotion of the two crutches over the surface and a mechanism to modify the locomotion of the crutches over the surface, wherein a limit on angular motion on the limiter is set and/or maintained by a processing unit.

19. The method of claim 18, wherein the locomotion facilitator is configured to change a direction of locomotion of the person using the gait device.

20. The method of claim 18, comprising modifying a length of a crutch of said two crutches in response to a change in the environment.

* * * * *